US012084807B2

(12) United States Patent
Mazzarella et al.

(10) Patent No.: US 12,084,807 B2
(45) Date of Patent: Sep. 10, 2024

(54) SIDE ACCESS PANEL FOR LINT FILTER OF LAUNDRY APPLIANCE

(71) Applicant: WHIRLPOOL CORPORATION, Benton Harbor, MI (US)

(72) Inventors: Antonio Mazzarella, Fabriano (IT); Justin Nguyen, Wyoming, MI (US); Pedro Rouin, Stevensville, MI (US); Adriano Tebaldi, São Paulo (BR); Daniel Schurr, Wyoming, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 660 days.

(21) Appl. No.: 17/242,808

(22) Filed: Apr. 28, 2021

(65) Prior Publication Data

US 2022/0349112 A1 Nov. 3, 2022

(51) Int. Cl.
*D06F 58/22* (2006.01)
*D06F 58/02* (2006.01)

(52) U.S. Cl.
CPC ..... *D06F 58/22* (2013.01); *D06F 58/02* (2013.01)

(58) Field of Classification Search
CPC ..... D06F 58/22; D06F 58/02
USPC ..... 34/82, 595–610
See application file for complete search history.

(56) References Cited

U.S. PATENT DOCUMENTS 2,460,422 A * 2/1949 Koppel ..... D06F 58/263 34/606
2,742,708 A * 4/1956 Mccormick ..... D06F 58/24 34/604
3,060,593 A * 10/1962 Flora ..... D06F 58/08 310/83
3,064,358 A 11/1962 Giuffre
3,378,934 A * 4/1968 Erickson ..... D06F 58/22 55/482
4,700,492 A * 10/1987 Werner ..... D06F 58/22 34/403
5,651,188 A * 7/1997 Swanson ..... D06F 58/22 34/82
6,370,798 B1 * 4/2002 Gonzalez, Sr. ..... D06F 58/02 219/544
7,458,171 B1 * 12/2008 Lentz ..... D06F 58/206 34/595

(Continued)

FOREIGN PATENT DOCUMENTS

AU 2012265068 B2 * 3/2017 ..... D06F 58/04
CA 2921689 A1 * 9/2017

(Continued)

*Primary Examiner* — Stephen M Gravini

(74) *Attorney, Agent, or Firm* — Price Heneveld LLP

(57) ABSTRACT

A laundry appliance includes an outer cabinet having opposing sidewalls that extend between a front panel and a rear panel. A blower is positioned within the outer cabinet and delivers process air through an airflow path. A rotating drum receives articles to be processed. The airflow path includes the rotating drum. A lint filter is selectively operable to a filtering position within a filter receptacle of the airflow path. The filtering position places a filter media of the lint filter within the airflow path. An access door is operable to a closed position within a door receptacle defined within a side panel of the opposing sidewalls. The door receptacle is aligned with the filter receptacle and the access door conceals the filter receptacle in the filtering position.

20 Claims, 12 Drawing Sheets

(56) References Cited

U.S. PATENT DOCUMENTS

| | | | | |
|---|---|---|---|---|
| 7,644,515 | B2 * | 1/2010 | Doh | D06F 58/22 34/603 |
| 8,490,438 | B2 | 7/2013 | Kim et al. | |
| 9,163,351 | B2 | 10/2015 | Kim et al. | |
| 10,584,440 | B2 | 3/2020 | Kim et al. | |
| 10,619,287 | B2 | 4/2020 | Lu et al. | |
| 11,441,257 | B2 | 9/2022 | Hato et al. | |
| 2006/0096335 | A1 | 5/2006 | Park et al. | |
| 2008/0196453 | A1 | 8/2008 | Heo et al. | |
| 2010/0229607 | A1 * | 9/2010 | Persson | D06F 37/26 68/19 |
| 2014/0165416 | A1 * | 6/2014 | Pillot | D06F 58/20 34/82 |
| 2020/0378055 | A1 | 12/2020 | Hato et al. | |
| 2022/0298718 | A1 * | 9/2022 | Ekbundit | D06F 58/32 |
| 2022/0349112 | A1 * | 11/2022 | Mazzarella | D06F 58/22 |
| 2023/0054143 | A1 * | 2/2023 | Acker | D06F 58/04 |

FOREIGN PATENT DOCUMENTS

| | | | | | |
|---|---|---|---|---|---|
| CN | 109898309 | A | | 6/2019 | |
| CN | 115341370 | A | * | 11/2022 | D06F 58/02 |
| DE | 29608272 | U1 | | 8/1996 | |
| EP | 4086384 | A1 | * | 11/2022 | D06F 58/02 |
| GB | 2300700 | A | | 11/1996 | |
| WO | 2006097901 | A2 | | 9/2006 | |
| WO | 2018121868 | A1 | | 7/2018 | |

* cited by examiner

SIDE ACCESS PANEL FOR LINT FILTER OF LAUNDRY APPLIANCE

FIELD OF THE DEVICE

The device is in the field of laundry appliances, and more specifically, a laundry appliance having a lint filter that is incorporated within a basement of the appliance and accessible via a side panel of the outer cabinet. The side panel can be removed for accessing the lint filter and removing and inserting the lint filter relative to the basement for the appliance. The access door is fitted within the side panel for accessing the lint filter as well as fasteners that secure the lint filter to the basement for the appliance.

SUMMARY OF THE DISCLOSURE

According to one aspect of the present disclosure, a laundry appliance includes an outer cabinet having opposing sidewalls that extend between a front panel and a rear panel. A blower is positioned within the outer cabinet and delivers process air through an airflow path. A rotating drum receives articles to be processed. The airflow path includes the rotating drum. A lint filter is selectively operable to a filtering position within a filter receptacle of the airflow path. The filtering position places a filter media of the lint filter within the airflow path. An access door is operable to a closed position within a door receptacle defined within a side panel of the opposing sidewalls. The door receptacle is aligned with the filter receptacle and the access door conceals the filter receptacle in the filtering position.

According to another aspect of the present disclosure, a laundry appliance includes a side panel of an outer cabinet. A blower delivers process air through an airflow path positioned within the cabinet. A lint filter is selectively operable to a filtering position within a filter receptacle of the airflow path. The filter receptacle extends from the side panel and through the airflow path. An access door of the filter receptacle is selectively positioned within a frame member to define a closed position. The frame member is secured within a side opening of the side panel. The access door is operable to the closed position within the frame member. The frame member and the side opening are aligned with the filter receptacle. The access door in the closed position conceals the lint filter within the filter receptacle.

According to yet another aspect of the present disclosure, a laundry appliance includes an outer cabinet having opposing sidewalls that extend between a front panel and a rear panel. A blower is positioned within the outer cabinet and that delivers process air through an airflow path. A rotating drum receives articles to be processed. The airflow path includes the rotating drum. A lint filter is selectively operable to a filtering position within a filter receptacle of the airflow path. The filtering position places a filter media of the lint filter within the airflow path. The filter receptacle extends from a side panel of the opposing sidewalls and into a basement section that is below the rotating drum. An access door is operable to a closed position within a door receptacle defined within the side panel of the opposing sidewalls. The door receptacle is aligned with the filter receptacle and the access door conceals the filter receptacle in the filtering position.

These and other features, advantages, and objects of the present disclosure will be further understood and appreciated by those skilled in the art by reference to the following specification, claims, and appended drawings.

Figure 1:
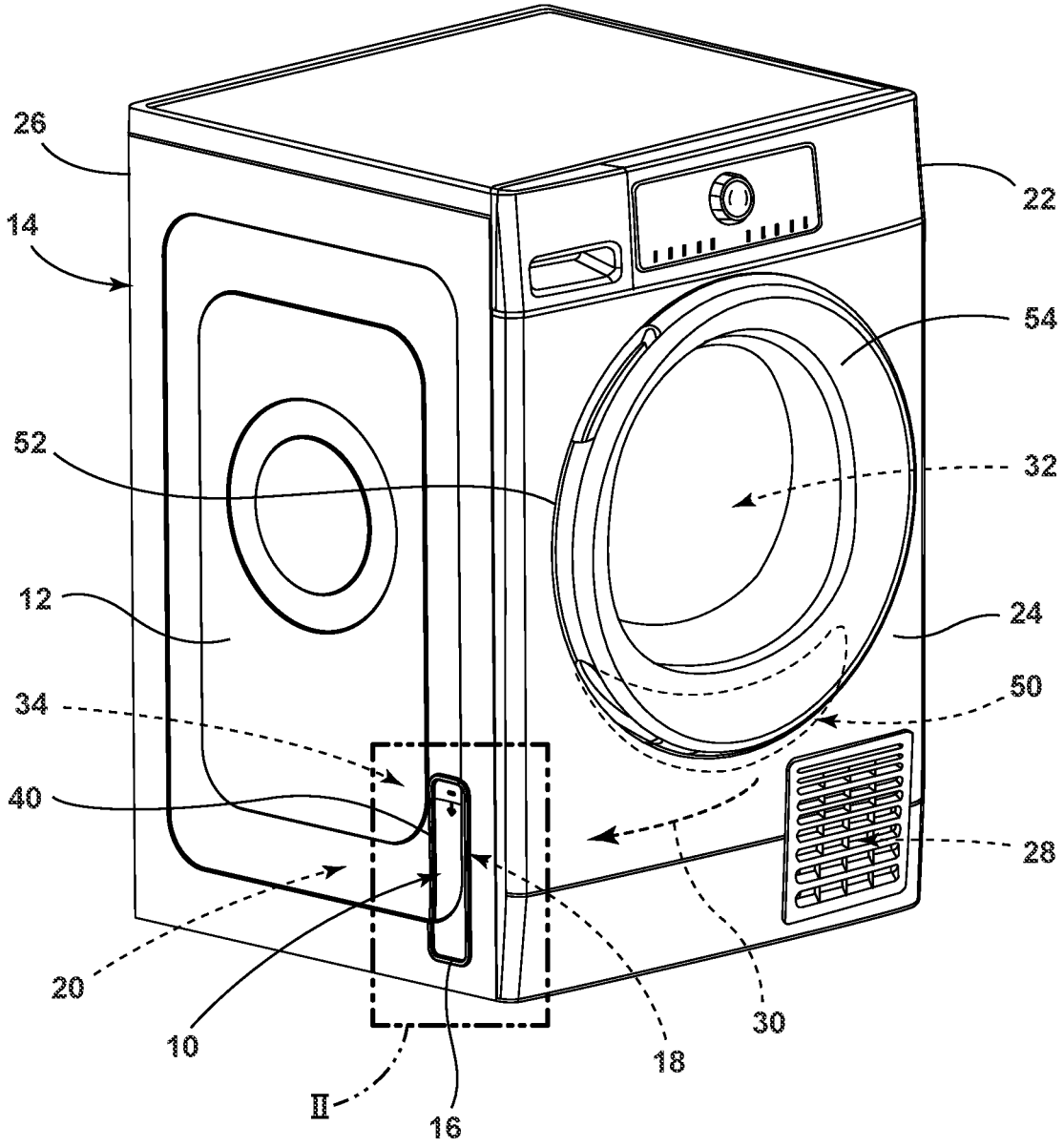
FIG. 1 is a side perspective view of a laundry appliance incorporating an aspect of the access door within a side panel for the appliance.
Figure 2:
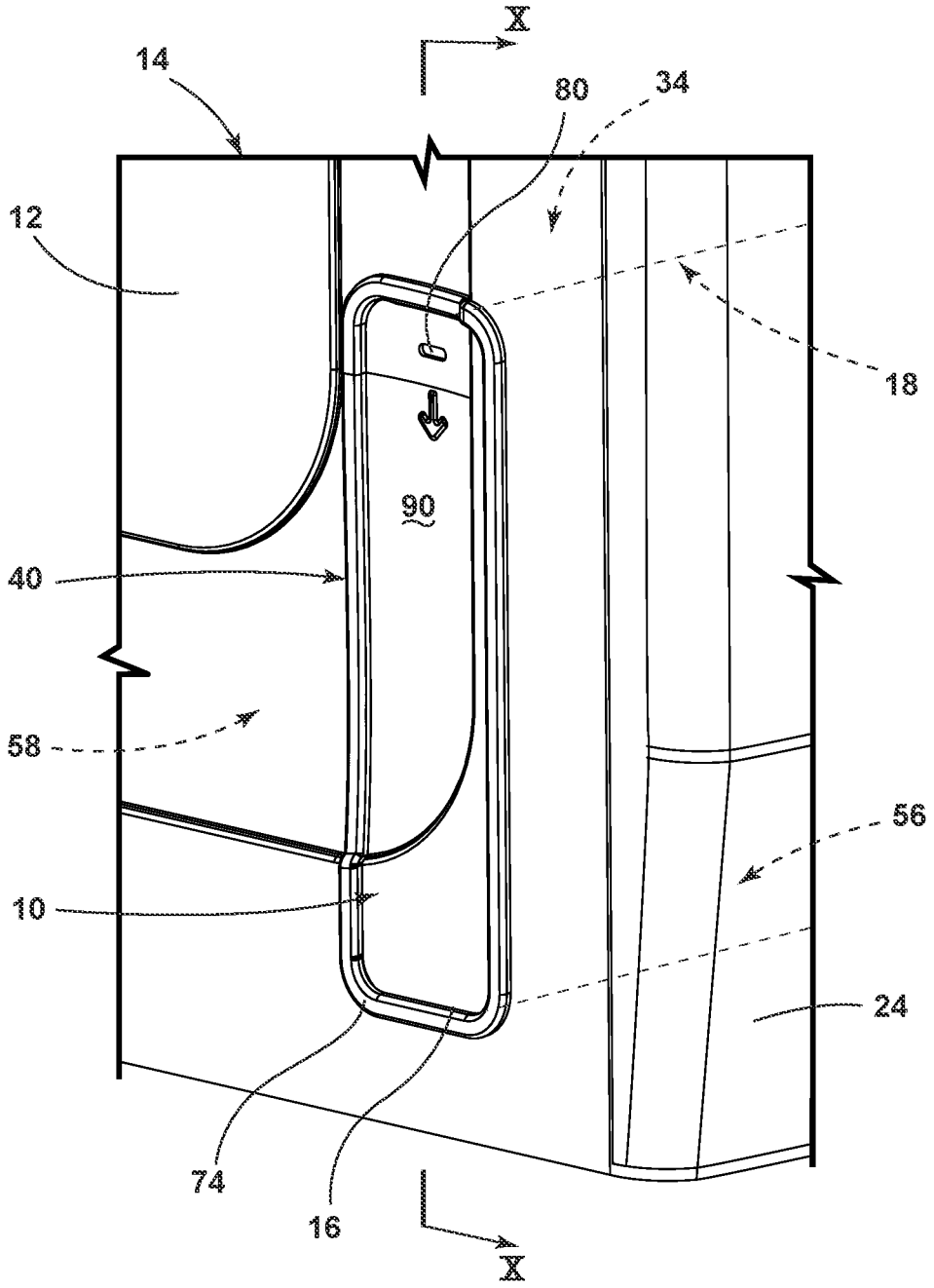
FIG. 2 is an enlarged perspective view of the access door of FIG. 1.
Figure 3:
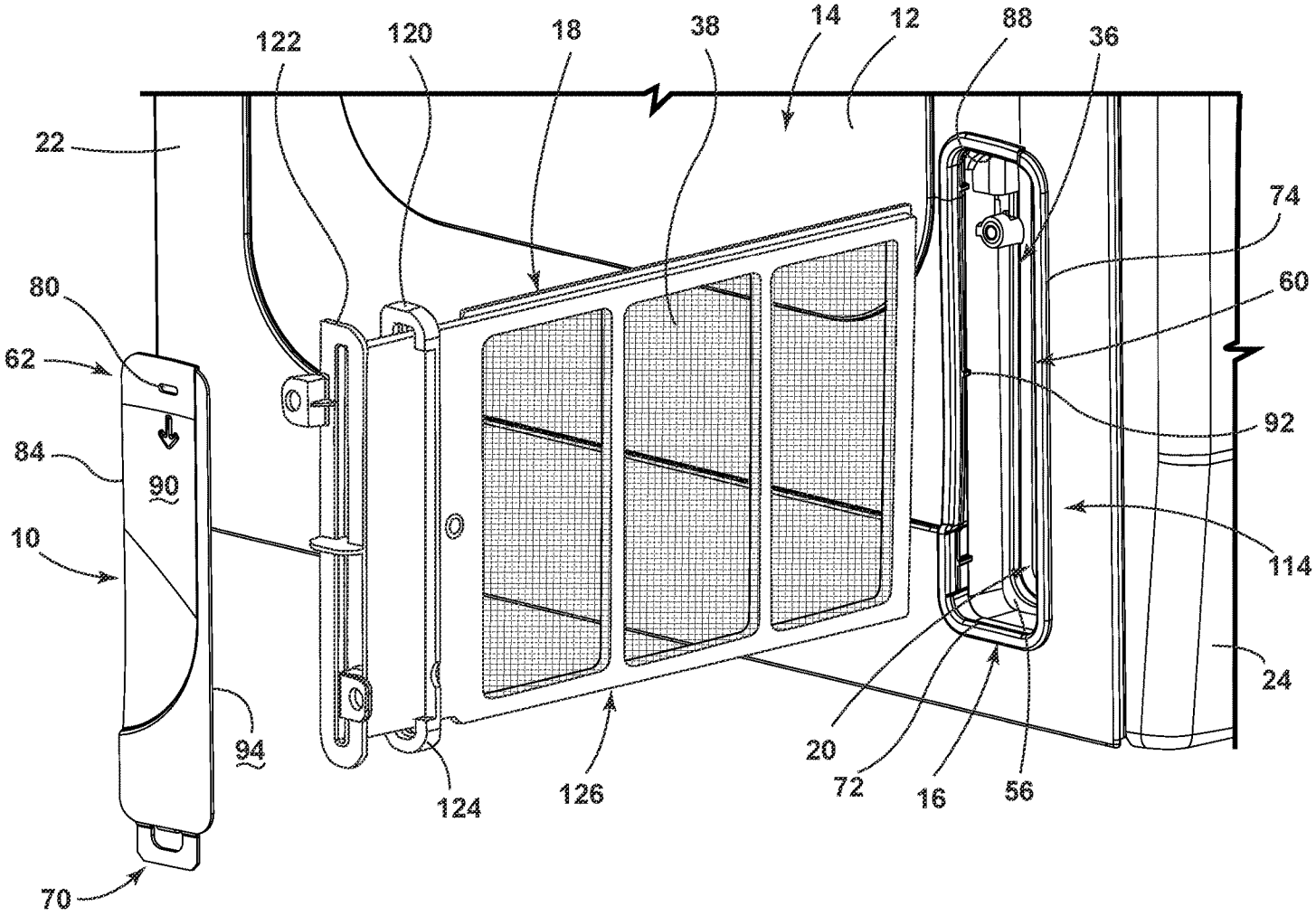
FIG. 3 is an exploded perspective view of the lint filter and access door for the laundry appliance.
Figure 6:
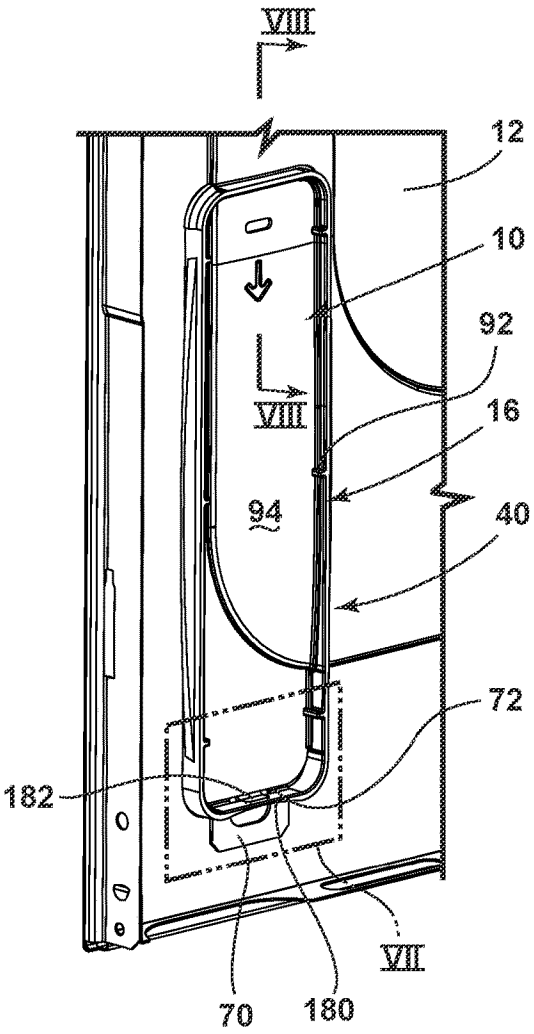
FIG. 6 is an interior perspective view of the side panel for the appliance and showing an aspect of the access door disposed within the side panel.
Figure 5:
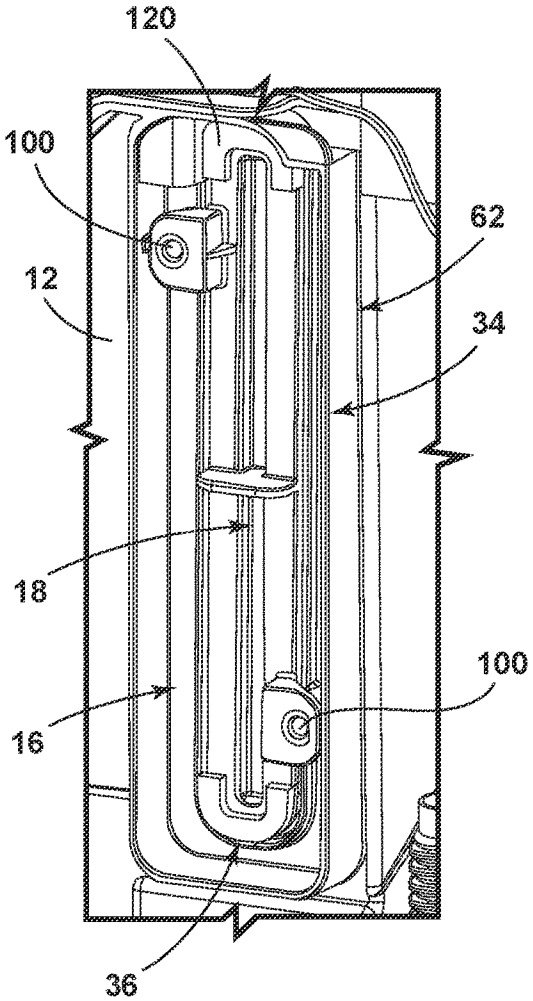
FIG. 5 is a perspective view of the lint filter of FIG. 4 and shown with the lint filter and a filter gasket removed.
Figure 4:
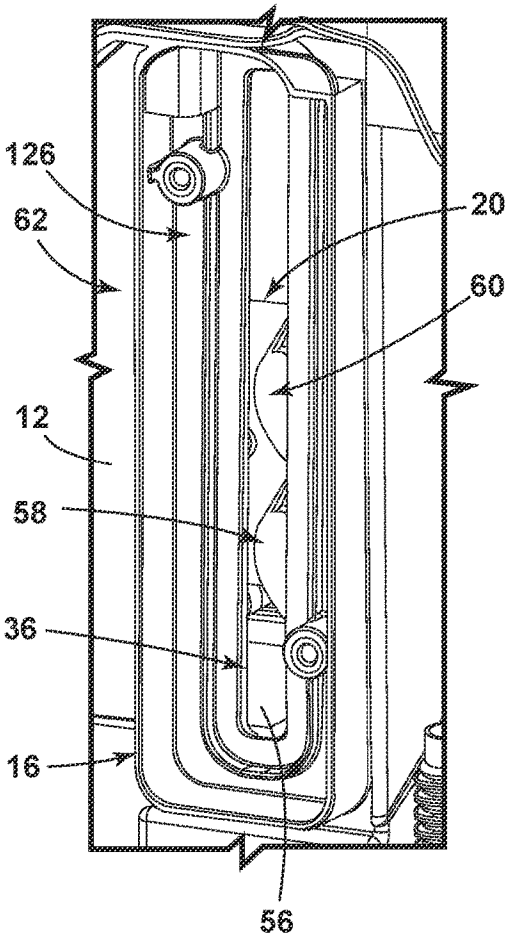
FIG. 4 is a perspective view of the basement portion of the appliance with the side panel removed and showing engagement of the lint filter with the basement.
Figure 8:
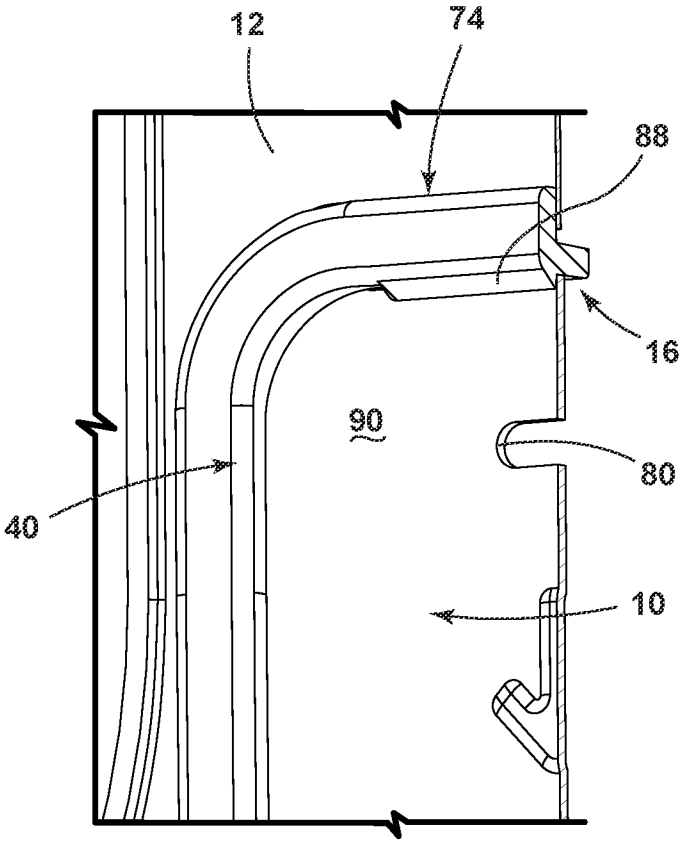
FIG. 8 is a cross-sectional view of the side panel of FIG. 6 taken along line VIII-VIII.
Figure 7:
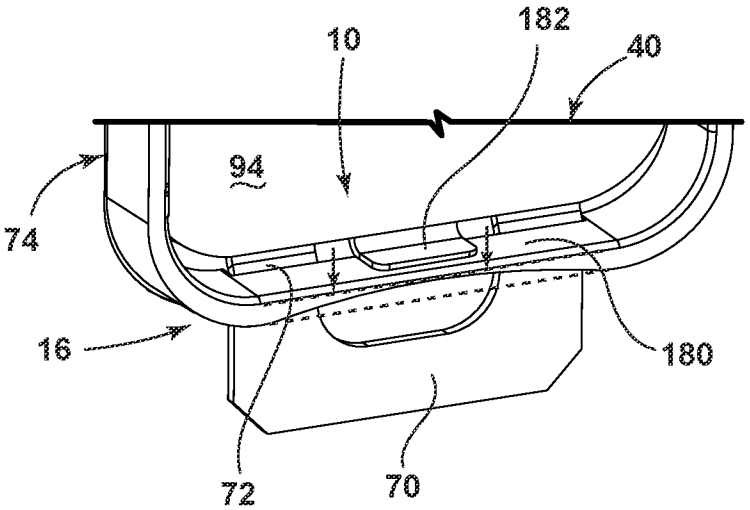
FIG. 7 is an enlarged perspective view of the side panel of FIG. 6 taken at area VII.
Figure 10:
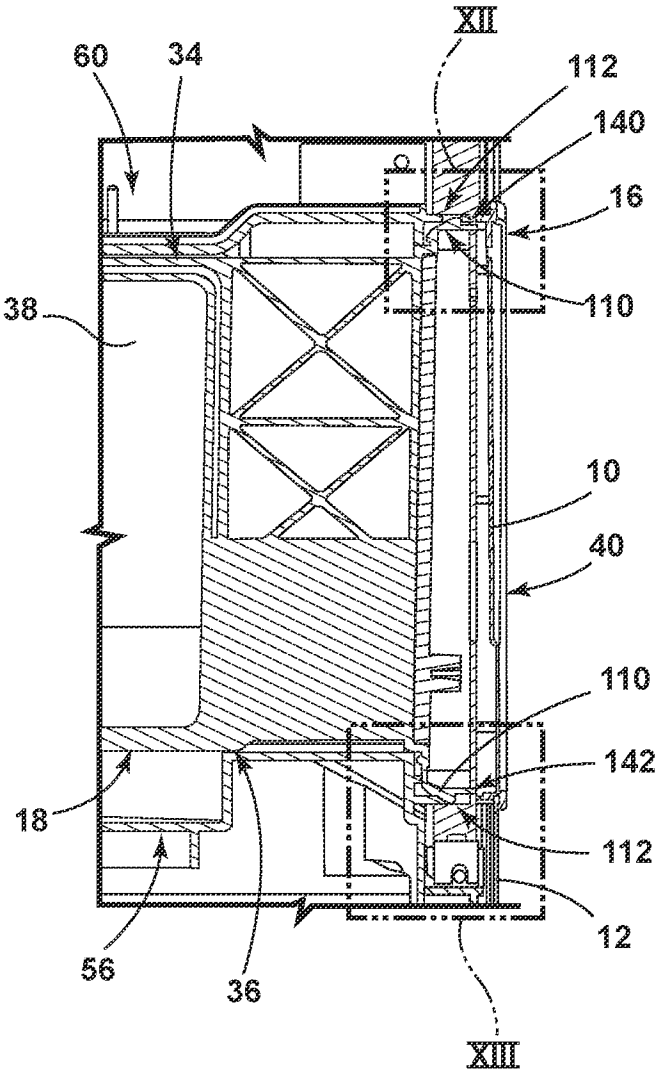
FIG. 10 is a cross-sectional view of the lint filter of FIG. 2 taken along line X-X.
Figure 9:
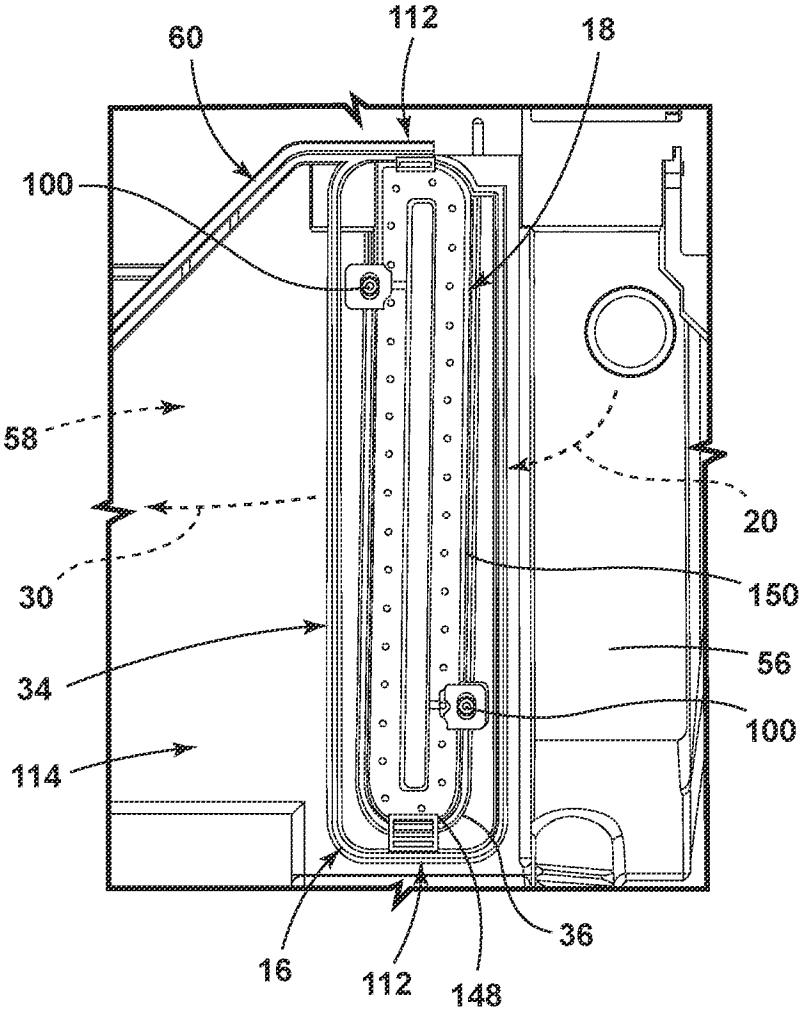
FIG. 9 is a side elevational view of the basement portion of the appliance and showing a fastening mechanism for securing the lint filter within the basement section of the laundry appliance.
Figure 12:
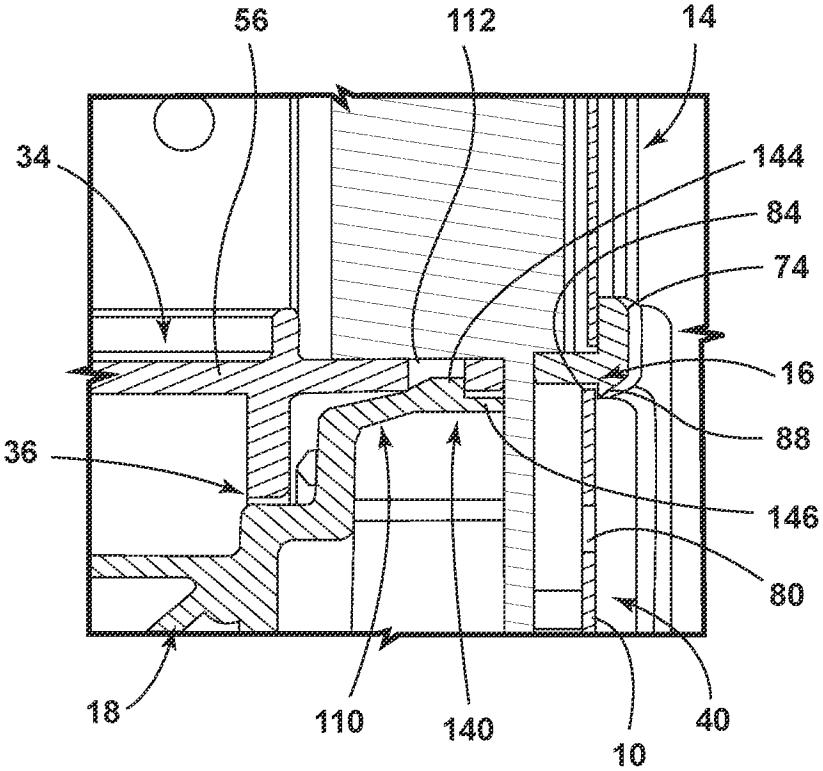
FIG. 12 is an enlarged cross-sectional view of FIG. 10 taken at area XII-XII.
Figure 11:
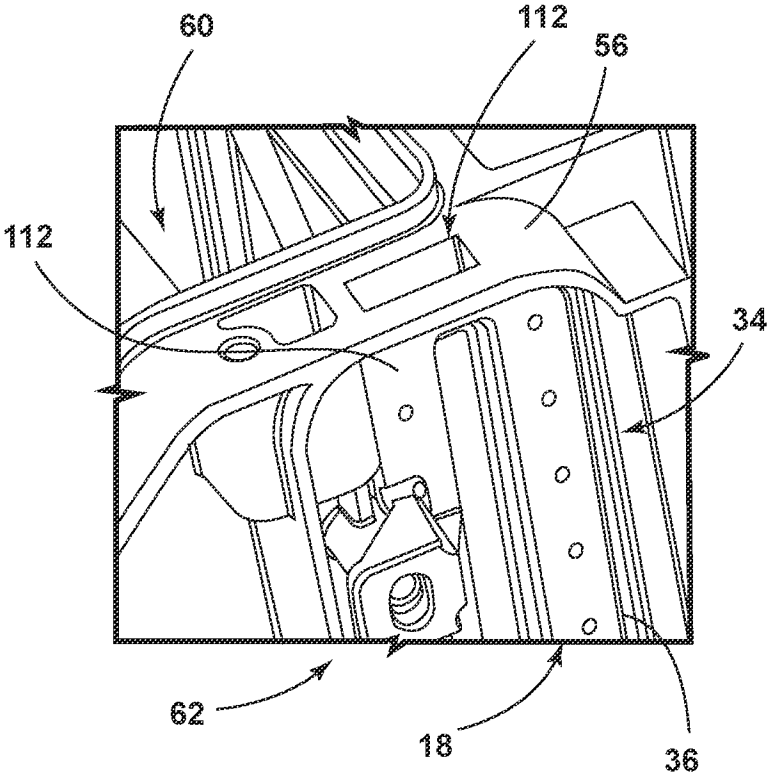
FIG. 11 is a top perspective view of the basement portion of the appliance of FIG. 9 and showing an upper slot for receiving a tab of the lint filter.
Figure 14:
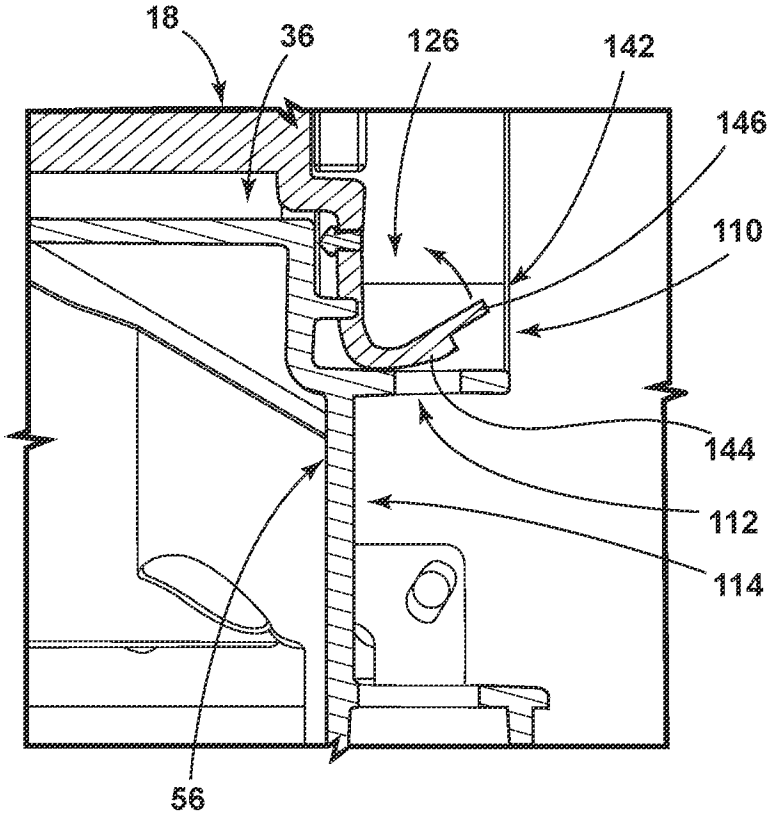
FIG. 14 is an enlarged cross-sectional view of FIG. 13 and shown with the lint filter removed.
Figure 13:
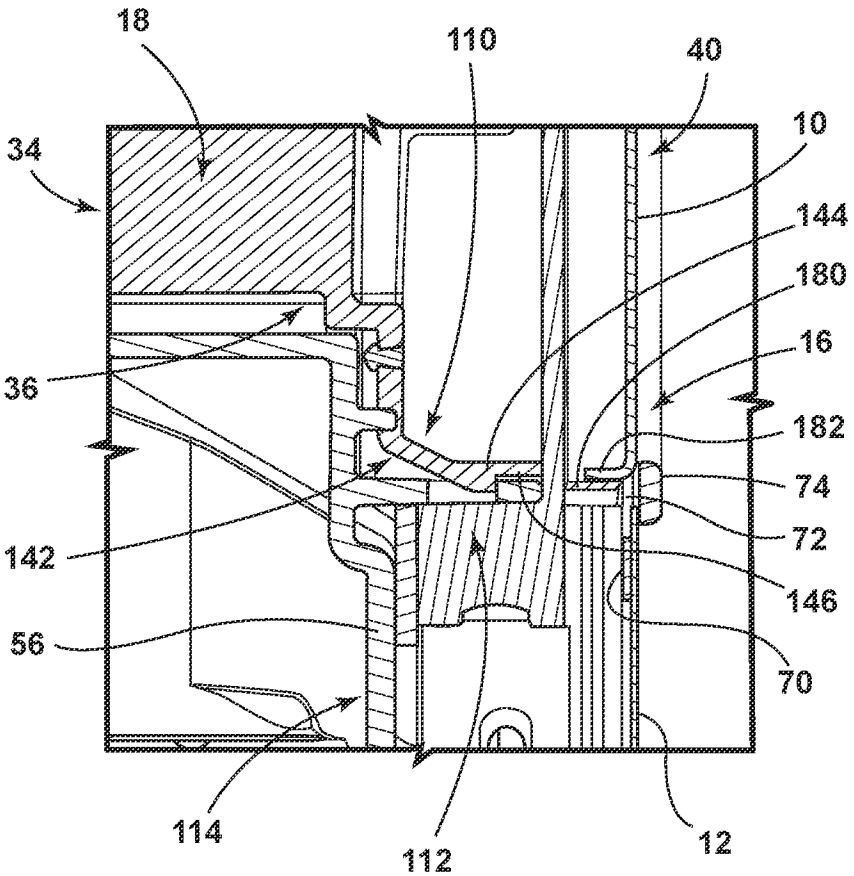
FIG. 13 is an enlarged cross-sectional view of the lint filter of FIG. 10 taken at area XIII-XIII.
Figure 16:
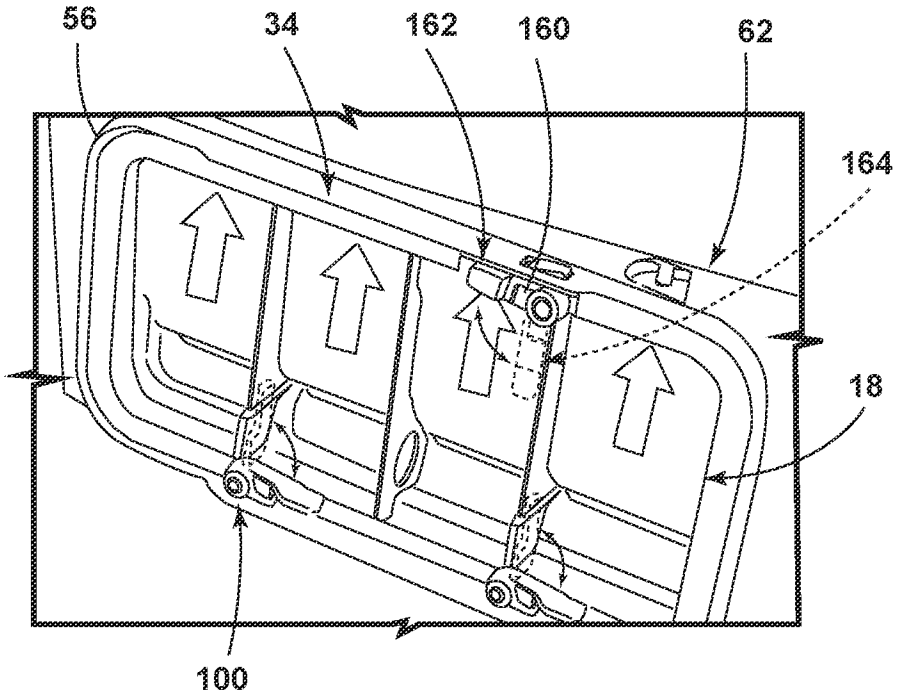
FIG. 16 is a perspective view of an aspect of the access door for the laundry appliance and showing rotational fastening mechanisms for securing the access door to the basement section of the appliance.
Figure 15:
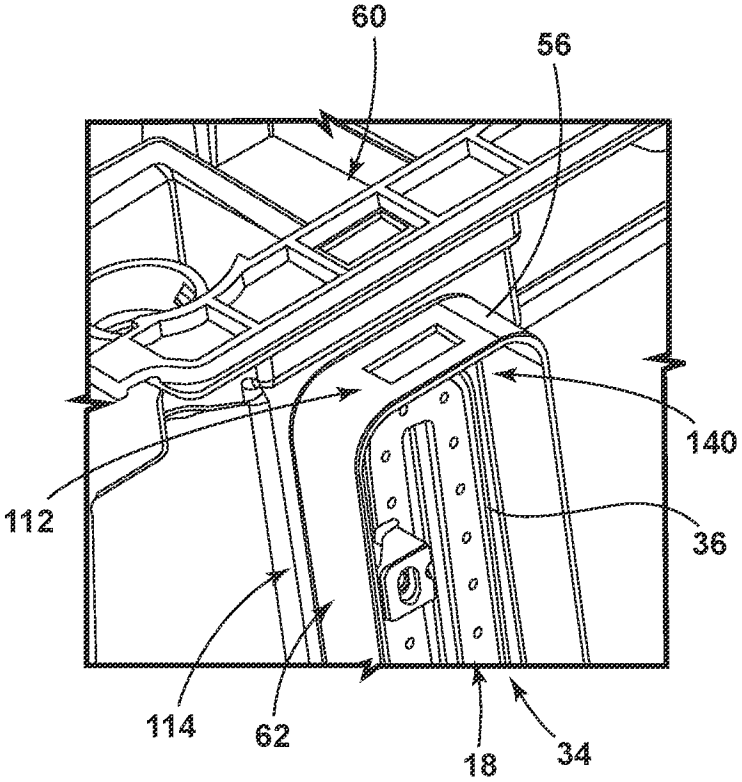
FIG. 15 is a perspective view of an aspect of the basement for the laundry appliance and showing locations for snapping engagements with the lint filter and the basement area of the appliance.
Figure 19:
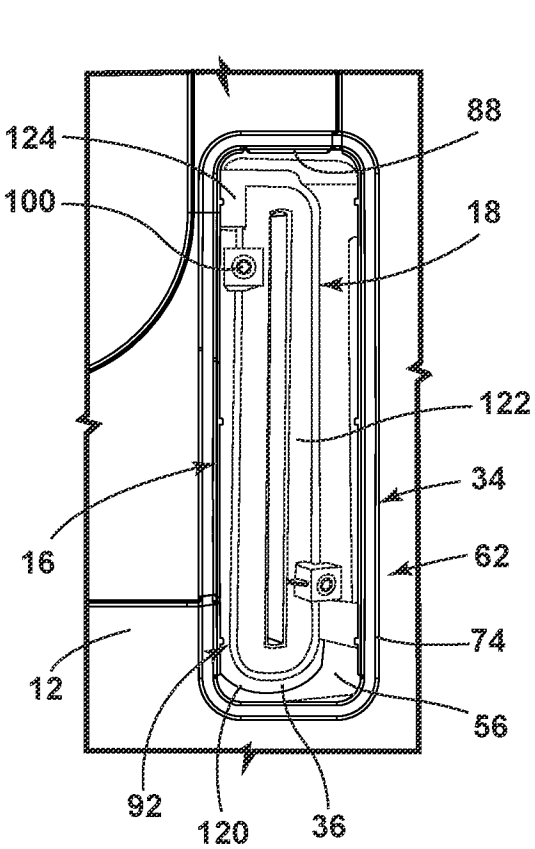
FIG. 19 is a perspective view of a side panel of FIG. 18 and showing the access door removed.
Figure 18:
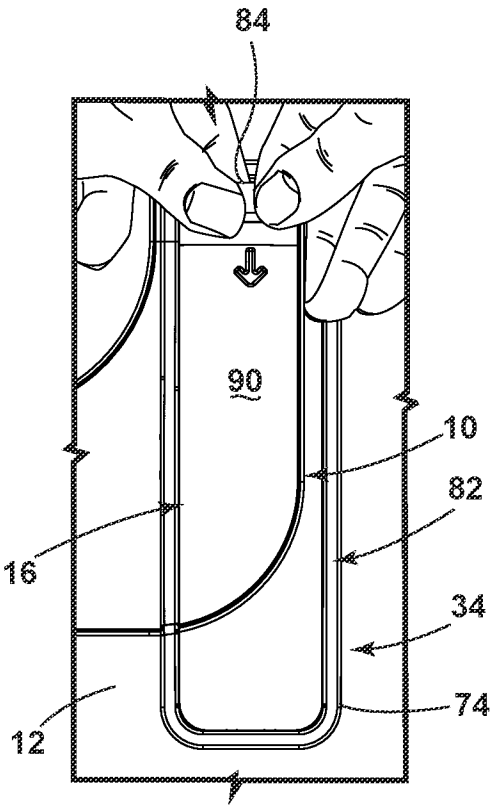
FIG. 18 is a perspective view of the side panel of FIG. 17 and showing separation of the access door from the side panel.
Figure 17:
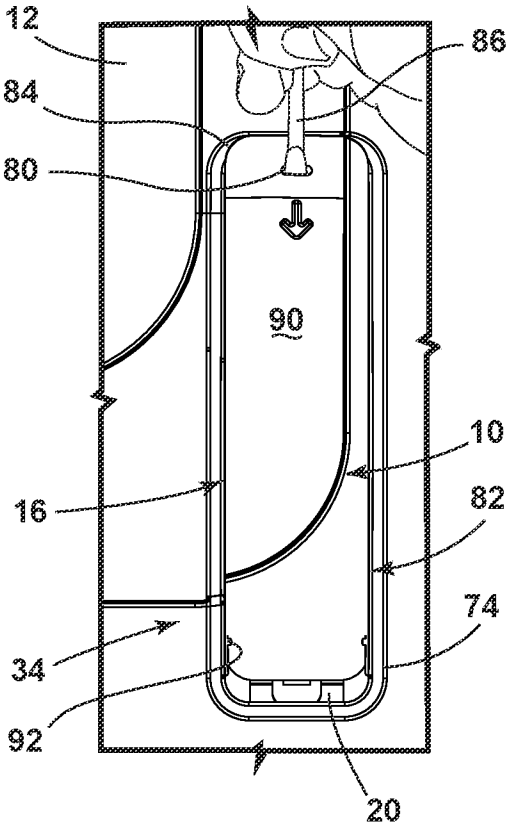
FIG. 17 is a perspective view of a side panel for the laundry appliance and showing removal of the access door from the side panel using a tool to dislodge the access door from the side panel.

The components in the figures are not necessarily to scale, emphasis instead being placed upon illustrating the principles described herein.

DETAILED DESCRIPTION

The present illustrated embodiments reside primarily in combinations of method steps and apparatus components related to an access door located within a side panel for accessing an interior lint filter that extends into a basement section of an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With respect to FIGS. 1-8, reference numeral 10 generally refers to an access door that is selectively secured within a side panel 12 that forms a portion of the outer cabinet 14 for an appliance, typically a laundry appliance. The side panel 12 includes a door receptacle 16 that receives the access door 10 that can be removed for accessing a lint filter 18 that is positioned within an airflow path 20 for the laundry appliance. According to various aspects of the device, the appliance includes the outer cabinet 14 having opposing sidewalls 22 that extend between a front panel 24 and a rear panel 26. A blower 28 is positioned within the outer cabinet 14 and delivers process air 30 through the airflow path 20. A rotating drum 32 is positioned within the outer cabinet 14, where the rotating drum 32 receives articles to be processed. The articles are processed using process air 30 that is moved through the airflow path 20, which includes the rotating drum 32. The lint filter 18 is selectively operable to a filtering position 34 that locates the lint filter 18 within a filter receptacle 36 of the airflow path 20. The filtering position 34 places a filter media 38 of the lint filter 18 within the airflow path 20 to capture lint and other particulate material contained within the process air 30. The access door 10 is operable to a closed position 40 within the door receptacle 16 defined within the side panel 12 of opposing sidewalls 22. The door receptacle 16 is aligned with the filter receptacle 36. In addition, the access door 10 conceals the filter receptacle 36 as well as the lint filter 18 while in the filtering position 34.

Typically, the lint filter 18 that is positioned within the filter receptacle 36 is in the form of a secondary lint filter 18. A primary filtering screen 50 is typically positioned proximate an aperture 52 of the rotating drum 32. This filtering screen 50 is readily accessible when a front door 54 within the aperture 52 is opened. In this manner, the filtering screen 50 can be cleaned after each use of the laundry appliance. The lint filter 18 that is positioned within the filter receptacle 36 is located within a basement 56 of the appliance and is designed to be removed periodically. The lint filter 18 is positioned downstream of the filtering screen 50 and upstream of a heat exchange assembly 58 for the appliance that cools and dehumidifies the process air 30 and subsequently heats the process air 30. While the filtering screen 50 is removed and cleaned frequently, removal of the lint filter 18 for cleaning and maintenance is typically performed during a service call of the laundry appliance. During such a service call, the interior portions 60 of the laundry appliance can be accessed for maintenance and repair. The positioning of the access door 10 within the side panel 12 is configured to restrict or limit access to the interior portions 60 of the outer cabinet 14. Access to the filter receptacle 36 is typically achieved through moving the entire appliance away from an obstruction, such as a wall or another appliance, so that the access door 10 can be manipulated and moved from the closed position 40 to a maintenance position 62 for accessing the filter receptacle 36 in the lint filter 18, as will be described more fully below.

Referring again to FIGS. 1-8, the access door 10 includes a latching tab 70 that engages a slot 72 that is defined within the door receptacle 16. The slot 72 can be defined within a portion of the side panel 12. In such an embodiment, the slot 72 is integrally formed within a portion of the side panel 12 that may be bent or otherwise formed into the door receptacle 16. It is also contemplated that the door receptacle 16 can include a frame member 74 that is disposed within the side panel 12. In such an aspect of the device, the slot 72 that receives the latching tab 70 in the access door 10 can be defined within the frame member 74 of the door receptacle 16. This slot 72 can also be defined between the frame member 74 and the side panel 12 for receiving the latching tab 70 of the access door 10.

Referring now to FIGS. 2-12, the access door 10 includes an internal aperture 80 that is used to bend or otherwise deflect the access door 10 within the door receptacle 16 while in the closed position 40. This deflection of the access door 10 operates the access door 10 to a dislodged position 82. In this dislodged position 82, at least one door edge 84 of the access door 10 is separated from the door receptacle 16. Typically, the internal aperture 80 of the access door 10 is manipulated using a tool 86, such as a screwdriver or other similar prying device. Once in the dislodged position 82, the access door 10 can be manipulated by hand and without the use of tools 86 to separate the latching tab 70 from the slot 72. For operating the access door 10 between the closed position 40 and the dislodged position 82, the frame member 74 includes an exterior retention feature 88 that engages an exterior surface 90 of the access door 10 while in the closed position 40. Additionally, in the closed position 40, the access door 10 is secured against interior door stops 92 of the frame member 74 that engage an interior surface 94 of the access door 10. Accordingly, in the closed position 40, the access door 10 is secured to the frame member 74 of the door receptacle 16 between the exterior retention feature 88 and the interior door stops 92. This is in addition to the securing engagement between the latching tab 70 of the access door 10 and the slot 72 that is defined within at least one of the frame member 74 and the side panel 12 for the outer cabinet 14.

As discussed herein, using a tool 86, a user can access the internal aperture 80 to deflect the access door 10 to the dislodged position 82. In this dislodged position 82, a portion of the access door 10, such as at least one of the door edges 84 of the access door 10, separates from the exterior retention feature 88 and at least a portion of the interior door stops 92. By releasing the door edge 84 of the access door 10, the user can grasp a portion of the access door 10 by hand and remove the latching tab 70 from the slot 72, thereby moving the access door 10 to the maintenance position 62. In the maintenance position 62, the filter receptacle 36 is accessible to the user for manipulating the fasteners 100 and the lint filter 18 within the filter receptacle 36.

In the maintenance position 62, the lint filter 18 can be removed from the filter receptacle 36 by removing at least one fastener 100 that fixedly secures the lint filter 18 to the basement 56 of the appliance. Typically, the fastener 100 is in the form of a screw or other rotational fastening device, such as a tab, clasp, or other similar rotational-type fastener 100. As will be described more fully below, it is also contemplated that the lint filter 18 can be secured to the basement 56 via various operable tabs and/or resilient tabs 110 that can engage securing structures 112 defined within the basement 56 of the appliance. The basement 56 is typically a structural component of the appliance that is disposed within a lower section 114 of the appliance, usually below the drum 32. The basement 56 is used to secure various operating mechanisms of the appliance, such as the blower 28, the heat exchange assembly 58, the lint filter 18 and other mechanisms. The basement 56 also defines various flow structures for moving process air 30 and fluid through portions of the appliance.

Referring again to FIGS. 2-12, the frame member 74 that is secured within the side opening of the side panel 12 can be secured to the side panel 12 via various interference engagements. In addition, the frame member 74 can be secured to the side panel 12 via separate fastening mechanisms, adhesives, combinations of these, and other similar attaching mechanisms and methods. In various aspects, it is contemplated that the frame member 74 can be incorporated within the side panel 12 as an integral feature. In the various aspects described herein, the frame member 74 provides additional reinforcing to this area of the side panel 12 for manipulating the access door 10 to the disengaged position when the access door 10 is deflected away from the closed position 40. The frame member 74 can be made of any one of various resilient materials that can accommodate the deflection of the access door 10 between the closed position 40 and the dislodged position 82.

Referring again to FIGS. 3-5, the lint filter 18 can include a gasket 120 that engages and partially surrounds an attachment flange 122 of the lint filter 18 for helping to secure the lint filter 18 within the filter receptacle 36. The gasket 120 also provides a sealing engagement between the lint filter 18 and basement 56. In this manner, process air 30 is not allowed to escape the outer cabinet 14 via the filter receptacle 36. This gasket 120 also provides for a compression feature that helps to secure the lint filter 18 to the basement 56 without damage to the lint filter 18. In this manner, as the lint filter 18 is secured to the basement 56, the gasket 120 is able to compress to prevent damage to the lint filter 18 as well as the basement 56 during installation of the lint filter 18. It is contemplated that the gasket 120 can surround a portion of the lint filter 18 to secure the gasket 120 to the lint filter 18. Accordingly, the gasket 120 can include enclosure ends 124 that surround a portion of the attachment flange 122 for the lint filter 18. This engagement helps to secure the gasket 120 to the attachment flange 122 of the lint filter 18 during operation of the lint filter 18 between the filtering position 34 and the removed position 126. When the access door 10 is in place, the gasket 120, the attachment flange 122 and other components of the lint filter 18 are fully concealed from view.

Referring again to FIGS. 1-12, the laundry appliance includes the side panel 12 of the outer cabinet 14. The blower 28 delivers process air 30 through the airflow path 20 that is positioned within the outer cabinet 14. The lint filter 18 is selectively operable to the filtering position 34 within the filter receptacle 36 of the airflow path 20. The filter receptacle 36 extends from the side panel 12 and extends through the airflow path 20 for placing the filter media 38 within the airflow path 20 to capture particulate matter from the process air 30. The access door 10 of the filter receptacle 36 is selectively positioned within the frame member 74 to define the closed position 40. The frame member 74 is secured within the side opening of the side panel 12. The access door 10 is operable to a closed position 40 within the frame member 74. The frame member 74 and the side opening are aligned with the filter receptacle 36 and the access door 10, when in the closed position 40, conceals the lint filter 18 in the filtering position 34.

Referring now to FIGS. 13-19, the lint filter 18 can be secured within the filter receptacle 36 using various resilient tabs 110 that engage securing structures 112 that are defined within the basement 56. In this manner, the lint filter 18 is selectively operable to the filtering position 34 within the filter receptacle 36, where the filter receptacle 36 extends from the side panel 12 of the opposing sidewalls 22 and into the basement 56 that is positioned below the rotating drum 32. The attachment flange 122 of the lint filter 18 can include the fastening portions described herein, where the fastening portions are configured to receive the rotational fastener 100, typically in the form of a screw or other rotating fastener 100. To assist in positioning the lint filter 18 in the filtering position 34, the attachment flange 122 can also include the resilient tabs 110 of the lint filter 18 to at least partially secure the lint filter 18 in the filtering position 34. These resilient tabs 110 can be used to position the lint filter 18, and the fasteners 100 are used to fixedly secure the lint filter 18 in the filtering position 34. The resilient tabs 110 engage various securing structures 112 that are defined within a positioning wall of the basement 56. This positioning wall can include openings that define the securing structures 112 that receive the resilient tabs 110. This positioning wall typically defines a portion of the filter receptacle 36. In this manner, the resilient tabs 110 can operated to place the lint filter 18 in the filtering position 34 such that the attachment flange 122 is positioned within the positioning wall. The resilient tabs 110 can also be manipulated to remove the attachment flange 122 and the lint filter 18 from the securing structures 112 and the filter receptacle 36.

Referring again to FIGS. 13-19, the lint filter 18 can include an upper resilient tab 140 and a lower resilient tab 142 that each include a clip 144 for engaging the opening of the securing structure 112 in the basement 56. Each resilient tab 110 also includes a lever 146 for operating the resilient tab 110. The resilient tabs 110 can be biased toward an attachment position 162. Using the levers 146, the resilient tabs 110 can be operated to a release position 164. During the installation of the lint filter 18 into the filtering position 34, the upper and lower resilient tabs 142 are biased toward one another in the release position 164 for passing by a portion of the basement 56 and entering into the securing structures 112 defined within the basement 56. Once the resilient tab 110 is aligned with the opening of the securing structure 112, the upper and lower resilient tabs 142 are biased outward to the attachment position 162 and secured within the openings within the basement 56. The levers 146 can be used to for moving the resilient tabs 110 to the release position 164 and removing the clips 144 of the resilient tabs 110 from the securing structures 112. This positioning of the resilient tabs 110 in the release position 164 allows for slidable operation of the lint filter 18 away from the filtering position 34 to the removed position 126. The resilient tabs 110 can be positioned at various locations along and around the attachment flange 122 of the lint filter 18. The positioning shown is exemplary in nature and the resilient tabs 110 can be positioned along the short side 148 and/or the long side 150 of the attachment flange 122. The positioning of the resilient tabs 110 also is configured to cooperate with the gasket 120 that engages the attachment flange 122.

Figure 20:
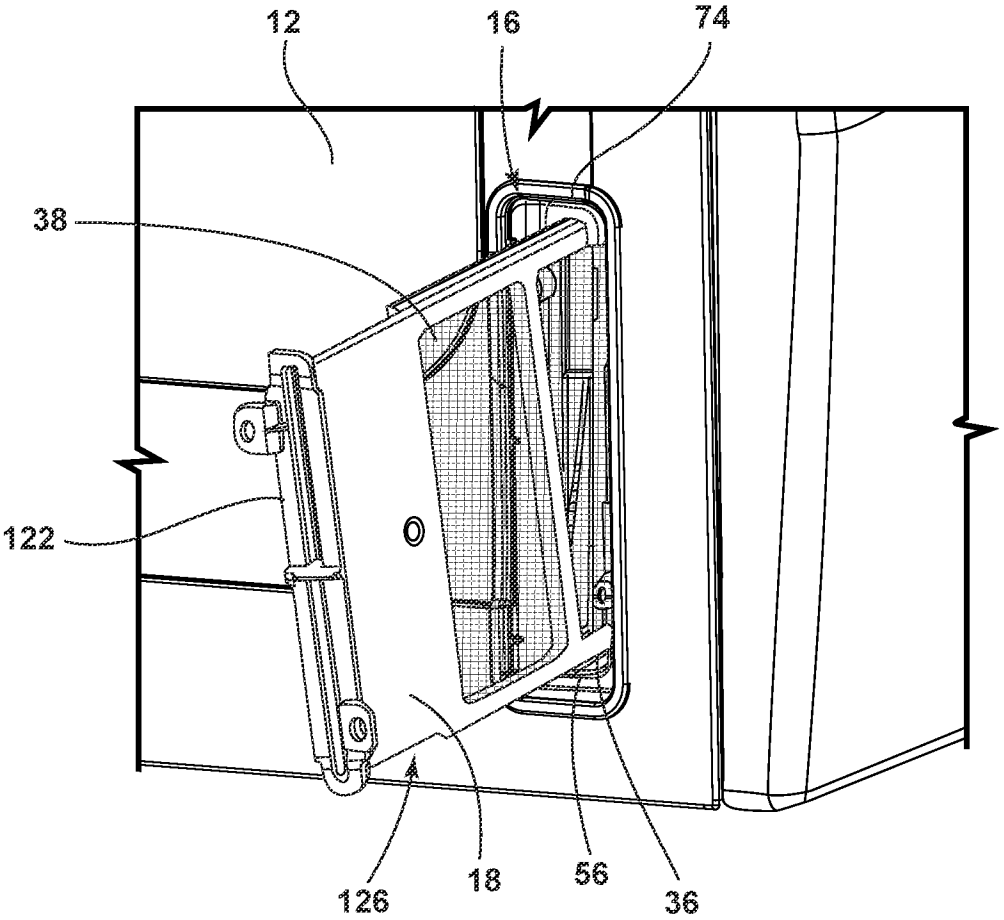
FIG. 20 is a perspective view of an aspect of the side panel and showing removal of the lint filter from the filter receptacle.
Figure 21:
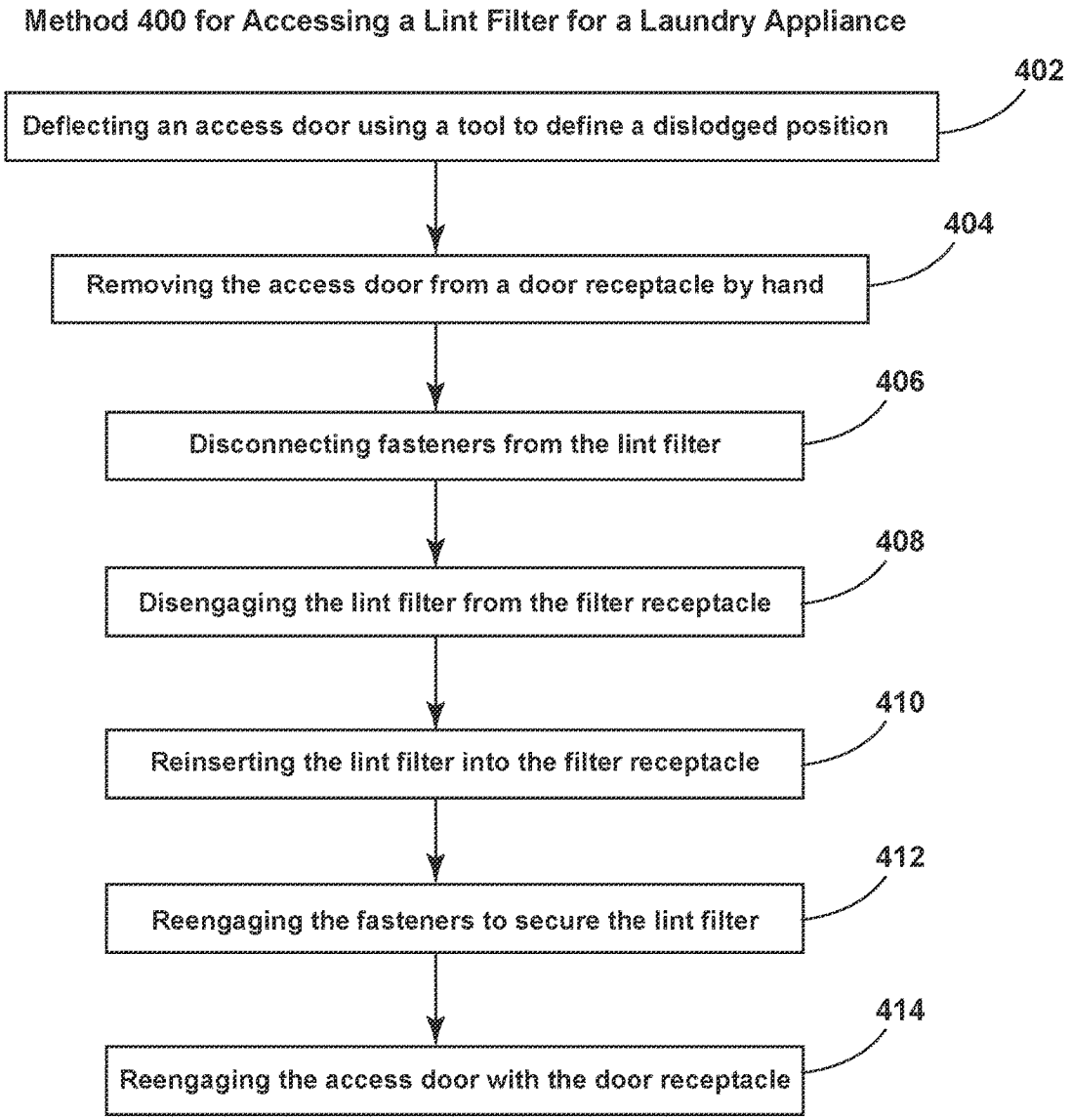
FIG. 21 is a linear diagram illustrating a method for accessing a lint filter for a laundry appliance.

Referring now to FIG. 20, in addition to the resilient tabs 110, the attachment flange 122 of the lint filter 18 can also include supplemental rotary fasteners 160 that can be used to temporarily secure the lint filter 18 in the filtering position 34 by engaging the securing structures 112 in the basement 56. These rotary fasteners 160 can be rotated to an attachment position 162 for securing the lint filter 18 in the filtering position 34 as well as a release position 164 for allowing slidable operation of the lint filter 18 relative to the filter receptacle 36.

According to various aspects of the device, the resilient tabs 110 and/or the rotary fasteners 160 can be used to secure the lint filter 18 in the filtering position 34. In certain embodiments, the resilient tabs 110 may be used without also including the rotary fasteners 160 or screws. Accordingly, the resilient tabs 110 can be used for fixedly securing the lint filter 18 in the filtering position 34. It is also contemplated that the resilient tabs 110 and fasteners 100 can be used in combination with one another to supplement these two fastening methods in case one of these methods fails over time.

Referring now to FIGS. 1-20, it is contemplated that the laundry appliance can include the outer cabinet 14 having opposing sidewalls 22 that extend between the front panel 24 and the rear panel 26. The blower 28 is positioned within the outer cabinet 14 and delivers process air 30 through the airflow path 20. The rotating drum 32 receives articles to be processed. The airflow path 20 includes the rotating drum 32 for delivering process air 30 into the rotating drum 32 for dehumidifying the air within the rotating drum 32 and the articles therein. The lint filter 18 is selectively operable to the filtering position 34 within the filter receptacle 36 of the airflow path 20. The filtering position 34 places the filter media 38 of the lint filter 18 within the airflow path 20. The filter receptacle 36 extends from a side panel 12 of the opposing sidewalls 22 and extends into the basement 56 below the rotating drum 32. The access door 10 is operable to the closed position 40 within the door receptacle 16 that is defined within the side panel 12 of the opposing sidewalls 22. The door receptacle 16 is aligned with the filter receptacle 36 and the access door 10 conceals the filter receptacle 36 when the lint filter 18 is in the filtering position 34. The door aperture 52 of the side panel 12 includes the frame member 74 that is disposed within the side opening of the side panel 12. The access door 10 includes the latching tab 70 that engages the slot 72 that is defined by the frame member 74 and/or the frame member 74 in conjunction with the inside surface of the side panel 12.

According to various aspects of the device, the access door 10 that is positioned within the side panel 12 is used for periodic and intermittent maintenance of the lint filter 18 over time. It is typical that the lint filter 18 positioned within the basement 56 will need to be cleaned during maintenance checks performed by a service technician. These may occur every six months, every year, every two years, or other intermittent time period for proper operation of the laundry appliance and recommended maintenance thereof. The positioning of the access door 10 within the side panel 12 is intended to deter frequent access to the lint filter 18 by requiring that the laundry appliance be moved away from an obstruction, such as a wall or a separate appliance that is positioned near the side panel 12 of the appliance. By making it less convenient to operate the access door 10, it is contemplated that a user will allow maintenance of the lint filter 18 to be conducted by a service technician or other trained professional.

According to various aspects of the device, the access door 10 described herein can utilized within any one of various appliances. Such appliances can include, but are not limited to, dryers, combination washers and dryers, air filtering units, and other similar appliances that require intermittent maintenance of a filtering mechanism.

Referring again to FIGS. 1-20, the access door 10 is sized to allow access to only the lint filter 18 and the filter receptacle 36. Other components within the basement 56 are typically not visible or accessible via the door aperture 52 that receives the access door 10. Accordingly, even if the user has removed the access door 10, access would be limited to the filter receptacle 36 and the lint filter 18 contained therein.

Referring now to FIGS. 1-21, having described various aspects of the lint filter 18 and the access door 10 that conceals the lint filter 18 within the filter receptacle 36, a method 400 is disclosed for accessing the lint filter 18 for a laundry appliance. According to the method 400, a tool 86 is used to engage the internal aperture 80 of the access door 10 to deflect the access door 10 to a dislodged position 82 (step 402). Once in the dislodged position 82, the access door 10 is removed by hand, and typically without the use of tools 86, to remove the access door 10 from the door receptacle 16 (step 404). Once the access door 10 is removed, the user can disconnect the various fasteners 100 that secure the lint filter 18 to the basement 56 (step 406). After the fasteners 100 have been removed, the lint filter 18 can be slidably disengaged from the filter receptacle 36 for maintenance, repair or replacement (step 408). The same lint filter 18 or a new lint filter 18 can then be inserted back into the filter receptacle 36 (step 410). The fasteners 100 can then be reengaged to fixedly secure the lint filter 18 to the filter receptacle 36 (step 412). After the lint filter 18 is fixedly secured in the filter receptacle 36, the access door 10 can be reengaged with the door receptacle 16 and secured in the closed position 40 (step 414). As discussed herein, the method 400 it typically performed after the appliance is moved away from some adjacent obstruction so that the side panel 12 having the access door 10 can be reached and manipulated from the closed position 40 to the dislodged position 82.

Movement of the access door 10 from the dislodged position 82 back to the closed position 40 can be accomplished by deflecting a certain portion of the frame member 74, typically the exterior retention feature 88, to allow the door edge 84 of the access door 10 to move into the closed position 40. In addition, the frame member 74 can include a deflecting member 180 that cooperates with a securing tab 182 and the latching tab 70 to further secure the access door 10 in the closed position 40. The latching tab 70 is used to position the access door 10 laterally and the securing tab 182 rests on the deflecting member 180 in the closed position 40. This engagement with the deflecting member 180 helps to properly locate the access door 10 in the closed position 40 as well as the dislodged position 82. The deflecting member 180 of the frame can also be used to assist in operation of the door from the closed position 40 and the dislodged position 82. In various aspects of the device, the deflecting member 180 can be a resilient portion of the frame member 74 and can be a thinner section of the frame member 74 or could be made of material that is conductive to resilient deflection during operation of the access door 10 between the dislodged position 82 and the closed position 40.

According to various aspects of the device, the frame member 74 can be made of a plastic material that includes resilient structures that form the various securing features that engage the access door 10 in the closed position 40 with respect to the frame member 74. The frame member 74 can also be made of various metallic materials, coated materials, combinations thereof, and other similar materials that can be formed into resilient features that secure the access door 10 in the closed position 40, and also allow for manipulation of the access door 10 between the closed position 40 and the dislodged position 82.

According to another aspect of the present disclosure, a laundry appliance includes an outer cabinet having opposing sidewalls that extend between a front panel and a rear panel. A blower is positioned within the outer cabinet and delivers process air through an airflow path. A rotating drum receives articles to be processed. The airflow path includes the rotating drum. A lint filter is selectively operable to a filtering position within a filter receptacle of the airflow path. The filtering position places a filter media of the lint filter within the airflow path. An access door is operable to a closed position within a door receptacle defined within a side panel of the opposing sidewalls. The door receptacle is aligned with the filter receptacle and the access door conceals the filter receptacle in the filtering position.

According to another aspect, the access door includes a latching tab that engages a slot defined within the door receptacle.

According to yet another aspect, the access door includes an internal aperture that is used to deflect the access door within the door receptacle to operate the access door to a dislodged position. The dislodged position is defined by at least one door edge of the access door being separated from the door receptacle.

According to another aspect of the present disclosure, the door receptacle includes a frame member that is disposed within a side opening defined within the side panel.

According to another aspect, the frame member is secured within the side opening via an interference engagement.

According to yet another aspect, the lint filter is secured in the filtering position via at least one fastener.

According to another aspect of the present disclosure, the at least one fastener includes a screw.

According to another aspect, the lint filter includes a gasket that is concealed by the access door in the closed position.

According to yet another aspect, the frame member includes an exterior retention feature that engages an exterior surface of the access door in the closed position. The frame member includes interior door stops that engage an interior surface of the access door in the closed position.

According to another aspect of the present disclosure, the frame member includes a deflecting member that cooperates with a securing tab and the latching tab to further secure the access door in the closed position.

According to another aspect, a laundry appliance includes a side panel of an outer cabinet. A blower delivers process air through an airflow path positioned within the cabinet. A lint filter is selectively operable to a filtering position within a filter receptacle of the airflow path. The filter receptacle extends from the side panel and through the airflow path. An access door of the filter receptacle is selectively positioned within a frame member to define a closed position. The frame member is secured within a side opening of the side panel. The access door is operable to the closed position within the frame member. The frame member and the side opening are aligned with the filter receptacle. The access door in the closed position conceals the lint filter within the filter receptacle.

According to yet another aspect, the frame member is secured within the side opening via an interference engagement.

According to another aspect of the present disclosure, the access door includes a latching tab that engages a slot defined within the frame member.

According to another aspect, the access door includes an internal aperture that is used to deflect the access door within the frame member to operate the access door to a dislodged position. The dislodged position is defined by at least one door edge of the access door being separated from the frame member.

According to yet another aspect, the lint filter is secured in the filtering position via at least one fastener.

According to another aspect of the present disclosure, the at least one fastener includes a rotational fastener.

According to another aspect, the filter receptacle includes a gasket that is concealed by the access door in the closed position.

According to yet another aspect, the frame member includes an exterior retention feature that engages an exterior surface of the access door in the closed position. The frame member includes interior door stops that engage an interior surface of the access door in the closed position. The frame member includes a deflecting member that cooperates with a securing tab and the latching tab to further secure the access door in the closed position.

According to another aspect of the present disclosure, a laundry appliance includes an outer cabinet having opposing sidewalls that extend between a front panel and a rear panel. A blower is positioned within the outer cabinet and that delivers process air through an airflow path. A rotating drum receives articles to be processed. The airflow path includes the rotating drum. A lint filter is selectively operable to a filtering position within a filter receptacle of the airflow path. The filtering position places a filter media of the lint filter within the airflow path. The filter receptacle extends from a side panel of the opposing sidewalls and into a basement section that is below the rotating drum. An access door is operable to a closed position within a door receptacle defined within the side panel of the opposing sidewalls. The door receptacle is aligned with the filter receptacle and the access door conceals the filter receptacle in the filtering position.

According to another aspect, the door receptacle includes a frame member that is disposed within a side opening defined within the side panel. The access door includes a latching tab that engages a slot defined by the frame member.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance comprising:

an outer cabinet having opposing sidewalls that extend between a front panel and a rear panel;

a blower positioned within the outer cabinet and that delivers process air through an airflow path;

a rotating drum that receives articles to be processed, wherein the airflow path includes the rotating drum;

a lint filter that is selectively operable to a filtering position within a filter receptacle of the airflow path, wherein the filtering position places a filter media of the lint filter within the airflow path; and an access door that is operable to a closed position within a door receptacle defined within a vertical side panel of the opposing sidewalls, wherein the door receptacle is aligned with the filter receptacle and the access door conceals the filter receptacle in the filtering position.

2. The laundry appliance of claim 1, wherein the access door includes a latching tab that engages a slot defined within the door receptacle.

3. The laundry appliance of claim 1, wherein the access door includes an internal aperture that is used to deflect the access door within the door receptacle to operate the access door to a dislodged position, the dislodged position defined by at least one door edge of the access door being separated from the door receptacle.

4. The laundry appliance of claim 2, wherein the door receptacle includes a frame member that is disposed within a side opening defined within the vertical side panel.

5. The laundry appliance of claim 4, wherein the frame member is secured within the side opening via an interference engagement.

6. The laundry appliance of claim 1, wherein the lint filter is secured in the filtering position via at least one fastener.

7. The laundry appliance of claim 6, wherein the at least one fastener includes a screw.

8. The laundry appliance of claim 1, wherein the lint filter includes a gasket that is concealed by the access door in the closed position.

9. The laundry appliance of claim 4, wherein the frame member includes an exterior retention feature that engages an exterior surface of the access door in the closed position, and wherein the frame member includes interior door stops that engage an interior surface of the access door in the closed position.

10. The laundry appliance of claim 9, wherein the frame member includes a deflecting member that cooperates with a securing tab and the latching tab to further secure the access door in the closed position.

11. A laundry appliance comprising:

a vertical side panel of an outer cabinet, wherein the vertical side panel is adjacent a front panel of the outer cabinet;

a blower that delivers process air through an airflow path positioned within the outer cabinet;

a lint filter that is selectively operable to a filtering position within a filter receptacle of the airflow path, wherein the filter receptacle extends from the vertical side panel and through the airflow path; and an access door of the filter receptacle that is selectively positioned within a frame member to define a closed position, wherein the frame member is secured within a side opening of the vertical side panel, and wherein the access door is operable to the closed position within the frame member, the frame member and the side opening being aligned with the filter receptacle, wherein the access door in the closed position conceals the lint filter within the filter receptacle.

12. The laundry appliance of claim 11, wherein the frame member is secured within the side opening via an interference engagement.

13. The laundry appliance of claim 11, wherein the access door includes a latching tab that engages a slot defined within the frame member.

14. The laundry appliance of claim 13, wherein the access door includes an internal aperture that is used to deflect the access door within the frame member to operate the access door to a dislodged position, the dislodged position defined by at least one door edge of the access door being separated from the frame member.

15. The laundry appliance of claim 11, wherein the lint filter is secured in the filtering position via at least one fastener.

16. The laundry appliance of claim 15, wherein the at least one fastener includes a rotational fastener.

17. The laundry appliance of claim 11, wherein the filter receptacle includes a gasket that is concealed by the access door in the closed position.

18. The laundry appliance of claim 14, wherein the frame member includes an exterior retention feature that engages an exterior surface of the access door in the closed position, and wherein the frame member includes interior door stops that engage an interior surface of the access door in the closed position, and wherein the frame member includes a deflecting member that cooperates with a securing tab and the latching tab to further secure the access door in the closed position.

19. A laundry appliance comprising:

an outer cabinet having opposing sidewalls that extend between a front panel and a rear panel;

a blower positioned within the outer cabinet and that delivers process air through an airflow path;

a rotating drum that receives articles to be processed, wherein the airflow path includes the rotating drum;

a lint filter that is selectively operable to a filtering position within a filter receptacle of the airflow path, wherein the filtering position places a filter media of the lint filter within the airflow path, the filter receptacle extending from a vertical side panel of the opposing sidewalls and into a basement section that is below the rotating drum; and an access door that is operable to a closed position within a door receptacle defined within the vertical side panel of the opposing sidewalls, wherein the door receptacle is aligned with the filter receptacle and the access door conceals the filter receptacle in the filtering position.

20. The laundry appliance of claim 19, wherein the door receptacle includes a frame member that is disposed within a side opening defined within the vertical side panel, and wherein the access door includes a latching tab that engages a slot defined by the frame member.

* * * * *